US005102077A

United States Patent [19]

Glendinning

[11] Patent Number: 5,102,077

[45] Date of Patent: Apr. 7, 1992

[54] UNIVERSAL PLATFORM BASE MEMBER

[76] Inventor: Scott Glendinning, 5515 Doyle St., #2, Emeryville, Calif. 94608

[21] Appl. No.: 613,994

[22] Filed: Nov. 15, 1990

Related U.S. Application Data

[63] Continuation-in-part of Ser. No. 511,246, Apr. 19, 1990.

[51] Int. Cl.[5] ..... F16M 11/20

[52] U.S. Cl. ..... 248/164; 108/157; 248/165

[58] Field of Search ..... 248/165, 164, 188.1; 182/151, 179; 108/153, 157, 111, 161; 211/189, 182; 52/263; 403/219, 403

[56] References Cited

U.S. PATENT DOCUMENTS

| | | | |
|---|---|---|---|
| 1,763,748 | 6/1930 | Best | 403/219 |
| 1,977,848 | 10/1934 | Gwynn | 108/157 |
| 2,097,172 | 10/1937 | Yurkovitch | 403/219 |
| 2,258,909 | 10/1941 | Reens | 403/219 |
| 3,074,771 | 1/1963 | Wilson | 108/157 X |
| 4,540,308 | 9/1985 | Colby | 211/189 |
| 4,824,058 | 4/1989 | Glendinning | 248/188.1 X |
| 4,854,531 | 8/1989 | Esposito | 403/403 |
| 4,883,246 | 11/1989 | Esposito | 248/188.1 X |
| 4,998,697 | 3/1991 | Esposito | 248/165 |

*Primary Examiner*—J. Franklin Foss
*Attorney, Agent, or Firm*—Bielen, Peterson & Lampe

[57] ABSTRACT

The support member for a platform such as a table which may be of universal construction. The support member includes an axially elongated member with a pair of slots which face outwardly from the elongated member in opposite directions, or a combination slot and notch. Each slot or notch includes a floor and a wall portion which extends along the elongated member. The slots extend along axes which lie in planes that are selectively orthogonally oriented relative to the axis of the elongated member or non-orthogonally oriented relative to the axis of the elongated member.

9 Claims, 7 Drawing Sheets

FIG-4
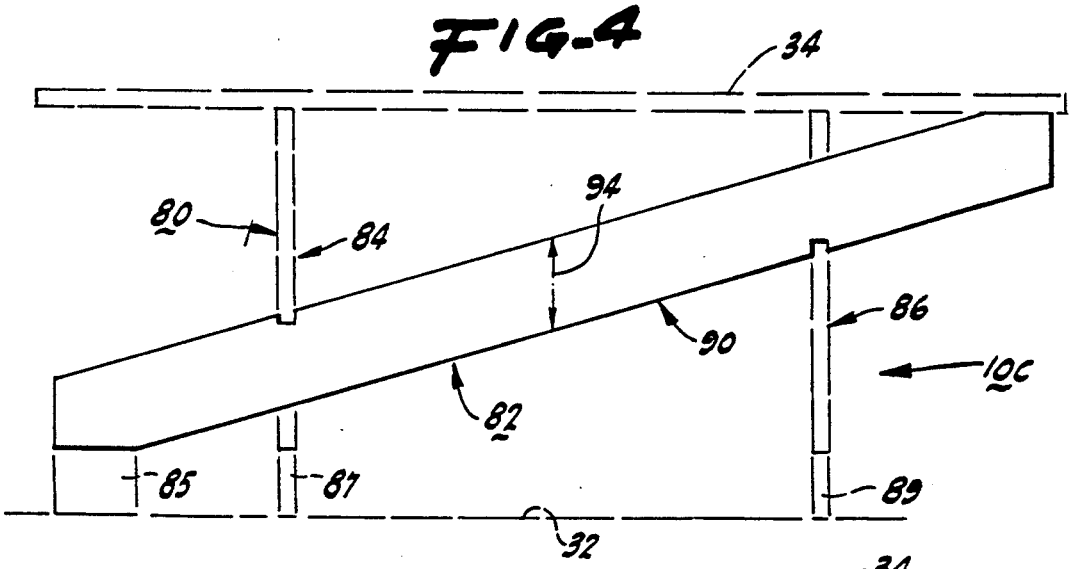
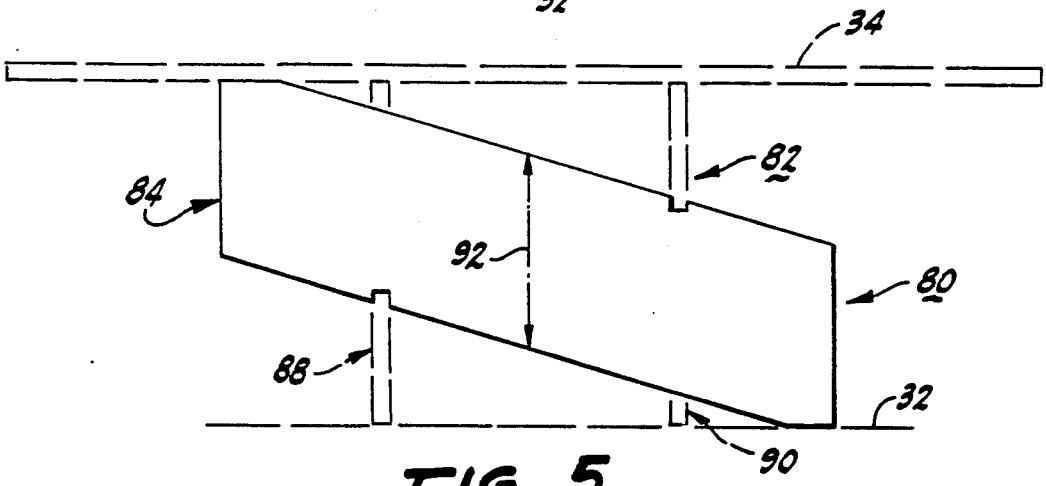
FIG-5
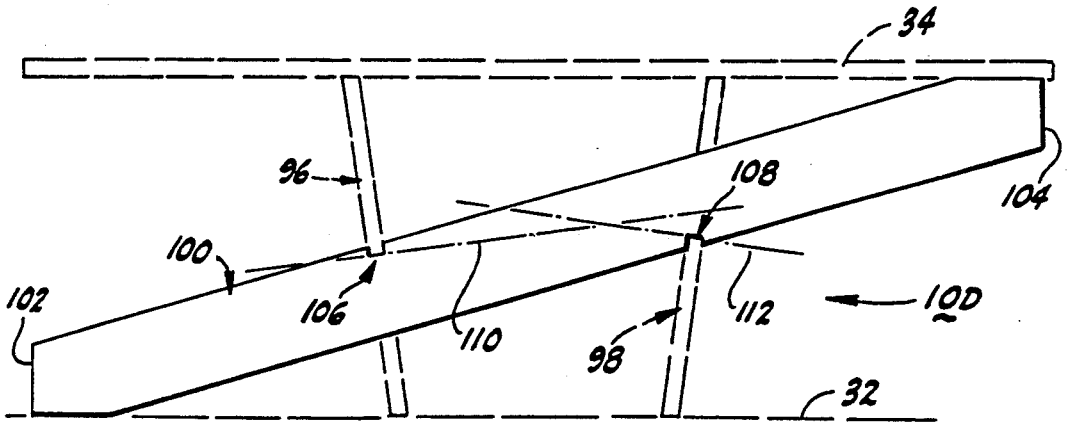
FIG-6

UNIVERSAL PLATFORM BASE MEMBER

CROSS-REFERENCES TO RELATED APPLICATION

The present application is a continuation-in-part of my copending application Ser. No. 07/511,246 filed Apr. 19, 1990.

BACKGROUND OF THE INVENTION

The present invention relates to a novel support member for a platform such as a table which may be of universal construction.

The mobility of furniture is often hampered by shear bulkiness in its construction. For example, certain tables are very difficult to transport from one site to another without the aid of several persons and, in some cases, alterations being performed to the edifice or structure housing the table.

Furniture which may be disassembled or collapsed possesses the distinct advantage of being easy to transport and store, in this regard. Many intricate collapsible furniture designs have been proposed which have proved to be unwieldy and impracticable for general usage.

Reference is made to U.S. Pat. No. 4,824,058 which described a platform or a table base having a universal member which have many of the objectives and solved many problems encountered in the prior art with collapsible furniture.

A support for a table or platform which further overcomes the disadvantages within the prior art would be a great advance in the field of equipment and furniture.

SUMMARY OF THE INVENTION

In accordance with the present invention a novel and useful support member capable of being assembled with like members into a base for a platform is herein provided.

The universal support structure of the present invention includes an elongated member which extends along an axis. The elongated member includes a transverse thickness dimension along the axis. First and second opposite side portions of the elongated member also extend parallel to the axis and terminate in first and second ends, respectively. Opposite edge surfaces separate the first and second side portions and first and second end portions of the elongated member.

The elongated member of the present invention includes a first slot having a floor portion which may be of flat configuration. The first slot also includes a wall portion which extends from the floor portion resulting in a depth dimension along the wall portion. The transverse distance along the floor portion of the slot is at least equal to the transverse thickness dimension of the elongated member relative to its axis. The first slot is open toward the first side portion of the elongated member. Similarly second slot including a floor portion and a wall portion is cut through and, thus, is open toward the opposite second side portion of the elongated member. The second slot may include a flat floor portion and possesses a second depth dimension along the wall portion of the same. The first and second slots may be positioned equidistantly from the first and second ends or may lie a respective similar distance from the first and second axis of the elongated member. In addition, the floor portions of the first and second slots may be substantially parallel to each other or lie in planes that intersect one another. In addition, the portions of the first and second slots may be co-planar. Moreover, the first and second slots may lie along axes that are orthogonally or non-orthogonally oriented with respect to the elongation member axis. Further, the first and second depth dimensions of the first and second slots may be identical or dissimilar. In this regard, certain embodiments of the elongated member of the present invention may take the form of a universal member, identical to other members for assemblage into a platform support. Other embodiments externalize in identical elongated members which are not of universal design. It should be noted that the elongated member hereinbefore described may be combined with three or more elongated members to form a platform support.

Further, certain elongated members of similar construction must be assembled in a particular order or orientation, unlike the universal version of the present invention. Also, one embodiment of the present invention entails provision of a pair of elongated members which are not similarly constructed. The first elongated member, in this case would possess the oppositely facing slots on opposite side portions found in the prior embodiments. Such slots would lie in axes and be oriented in a non-orthogonal manner relative to the axes of the elongated member. In other words, slots are angularly cut relative to the edges of the elongated member. Also, a pair of elongated members are also included each having outwardly facing open slots on opposite side portions of the elongated member. However, such pair of elongated members would include one slot which is orthogonally oriented to the axis of the elongated member and another slot which is non-orthogonally oriented thereto. Assemblage of this unit would constitute interlocking of three members into a support for a platform or table.

Each of the elongated members heretofore described include first and second surfaces positioned adjacent to the first and second ends thereof. The end surfaces appear as mitred portions of the elongated member and serve to offer positive contact with the base surface or the platform surface supported above the base surface. In the case of the universal elongated member, such first and second surfaces are interchangeable in this regard.

In another embodiment of the present invention the universal member may include one elongated member extending along an axis and having a transverse thickness dimension relative to the axis. The elongated member would include first and second side portions terminating in first and second ends. One slot is formed facing outwardly from the first portion of the elongated member. Such slot possesses a floor portion and a wall portion extending upwardly from the floor portion. The longitudinal distance along the floor portion is at least equal to the transverse thickness dimension of the elongated member. The transverse distance, however, of the slot is less than the thickness dimension of the elongated member. The slot possesses a certain depth along the wall portion. The one elongated member also includes a first notch having a floor portion greater than the transverse distance of the floor of the one slot. The depth of the first notch along the wall portion is at least equal to the depth dimension of the one slot. The first notch is open toward the second side portion of the one elongated member. A second notch is located adjacent the first notch on the second side portion of the one elongated member and also includes floor and wall portions.

The floor portion has a longitudinal distance or dimension less than or equal to the transverse distance of the one slot. In certain cases the floor of the one slot is substantially parallel to the floor of the second notch. Where the universal member provides a base with a pitched surface, the first and second notches are in substantially non-parallel orientation relative to one another. In addition, the first notch would lie in substantially non-parallel orientation relative to the first side portion of the one elongated member. Another elongated member may be angularly connected to the one elongated member to serve as a leg for the universal support structure.

In yet another embodiment of the present invention, the universal support structure may include the provision of another slot adjacent the one slot found on the first side of the one elongated member. Such another slot would be open on or toward the first side portion of the one elongated member and include a floor and wall portion as is the case with the prior embodiment having only one slot. Moreover, the depth dimension of the one slot may be different from the depth dimension of the adjacent another slot. In certain cases, the second notch would possess a depth dimension substantially equal to the depth dimension of the another slot. In this manner, the top of the base or a platform utilizing a plurality of universal supports would generally include a flush upper surface formed from each first side portion of the one elongated member used in each universal support structure. In this regard, another elongated member may be employed with the one elongated member, in this embodiment, to serve as a leg for the table base. The one and another elongated members, in this case, may be orthogonally connected.

It may be apparent that a novel and useful support structure for a platform has been described.

It is therefore an object of the present invention to provide a support structure for a platform which is collapsible into individual elongated members and easily transported from site to site for reassembly.

It is another object of the present invention to provide a support structure or platform which employs a plurality of elongated members that are of universal construction, thus facilitating manufacture and assembly of the same.

Another object of the present invention is to provide a support structure for a platform which employs three or more elongated members which may or may not be of universal construction, but are easily assembled and disassembled.

Yet another object of the present invention is to provide a support structure for a platform which includes a number of individual elements that are easily assembled and disassembled and provides sturdy support structure in the assembled condition.

Another object of the present invention is to provide a support structure for a platform which includes a universal member is aesthetically acceptable within the normal channels of trade.

A further object of the present invention is to provide a support structure using a universal member which possesses a flush upper surface formed by a plurality of such universal members.

The invention possesses other objects and advantages especially as concerns particular characteristics and features thereof which will become apparent as the specification continues.

BRIEF DESCRIPTION OF THE DRAWINGS

FIG. 4 is a side elevational view of a third embodiment of the present invention depicting a variation of all the embodiments herein, in phantom.

FIG. 5 is a side elevational view of the third embodiment shown in FIG. 4.

FIG. 6 is a side elevational view of a fourth embodiment of the present invention employing a universal elongated member.

For a better understanding of the invention reference is made to the following detailed description of the preferred embodiments thereof which should be referenced to the hereinabove described drawings.

DESCRIPTION OF THE PREFERRED EMBODIMENTS

Various aspects of the present invention will evolve from the following detailed description of the preferred embodiments thereof should be taken in conjunction with the above described drawings.

Figure 1:
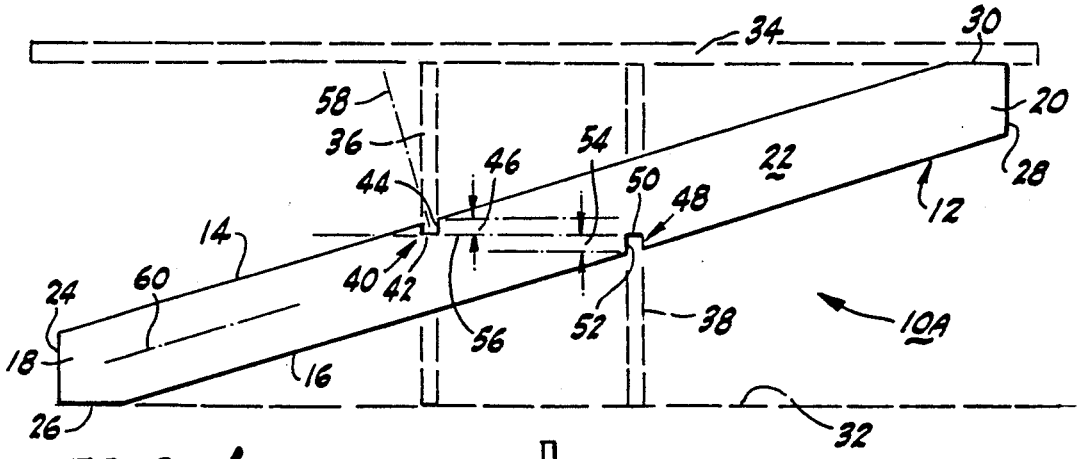
FIG. 1 is a side elevational view of a first embodiment of the present invention employing a universal member.

The invention as a whole as depicted in the drawings by reference character 10 and an upper case letter to distinguish various embodiments being described. In FIG. 1, the support structure 10A is shown which includes an elongated member 12 of universal construction having first side portion 14 and second side portion 16. Ends 18 and 20 are found at the termination of side portions 14 and 16. A flat surface 22 serves as an edge portion between sides 14 and 16. A similar edge portion (not shown) is positioned oppositely to edge portion 22 on elongated member 12. Ends 18 and 20 also include surfaces 24, 26, 28, and 30. Surfaces 26 and 30 may either serve to contact ground surface 32 or to support platform 34, both in phantom on FIG. 1. It should be apparent that elongated member is a universal member and that a quartet of the same may be assembled in any order or orientation to support platform 34 above ground surface 32. Identical elongated members 36 and 38 are depicted in phantom on FIG. 1 to form such an assembly.

Elongated member 12, and elongated members 36 and 38 and another not shown, include a first slot 40 having a floor portion 42 and a wall portion 44. Floor portion 42 and wall portion 44 are depicted as being flat and extending from flat edge 22 to the opposite edge of member 12. Thus, the transverse distance along floor 42 is at least equal to the thickness along side 14 or 16 of the elongated member 12. Such transverse dimension or thickness is better shown on members 36 and 38 of FIG. 1. First slot 40 is open toward side portion 14 of elongated member 12 and possesses a depth dimension 46 measured along wall 44, thereof.

Second slot 48 of member 12 is also included and possesses a floor portion 50 and a wall portion 52. Again, the transverse distance along floor portion 50 is at least equal to the thickness dimension across either side 14 or 16, thereof. Second slot 48 is open toward side portion 16 of elongated member 12 and includes a depth dimension 54 measured along wall portion 52. It should be noted that depth dimension 46 and depth dimension 54 are dissimilar. In addition, slots 40 and 48 are positioned equidistantly from end surfaces 24 and 28, respectively. Further, floor portions 42 and 50 of slots 40 and 48 are co-planar lying in plane 56. It should be apparent, that slots 42 and 48 are cut through elongated member 12 at right angles to edge 22 and thus are orthogonally oriented relative to edge 22. In other words, axis 56 which extends along floor 42 of slot 40 lies in a plane 58 which is orthogonally oriented relative to axis 60 of elongated member 12. Likewise, floor 50 of slot 48 extends along an axis which lies in a plane that is orthogonally oriented relative to axis 60 of elongated member 12.

Figure 2:
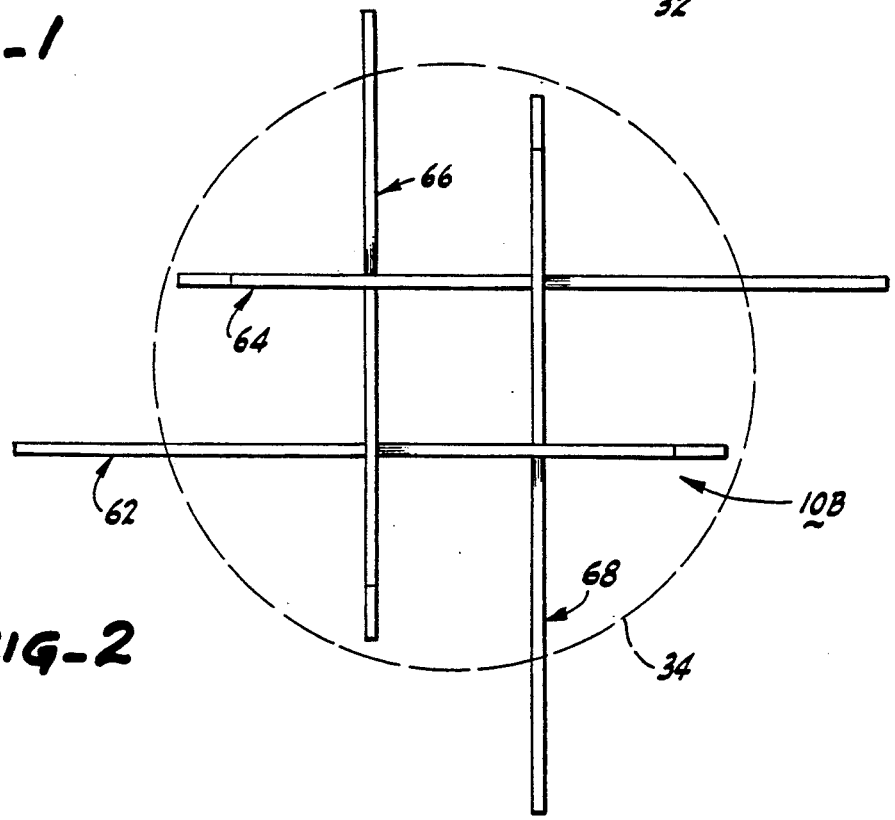
FIG. 2 is a top plan view of a second embodiment of the present invention utilizing a quartet of elongated members which are similarly constructed but not of universal construction.
Figure 3:
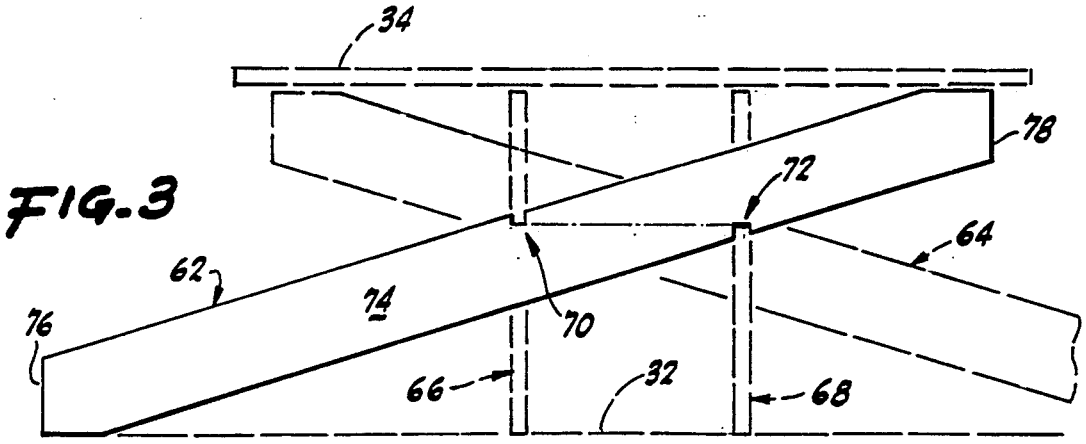
FIG. 3 is a side elevational view of an assemblage of the second embodiment depicted in FIG. 2.

Turning to FIGS. 2 and 3, another embodiment of the present invention 10B is depicted. Structure 10B includes elongated members 62, 64, 66, and 68 which are identical in construction and are depicted in FIGS. 2 and 3 as being assembled in its format to hold platform 34. With reference to FIG. 3, it may be observed that elongated member 62 includes a pair of oppositely facing slots 70 and 72 which are orthogonally oriented relative to edge surface 74. However, slots 70 and 72 are not equidistant from and edge surfaces 76 and 78, as is the case with the embodiment 10A depicted in FIG. 1. Thus, the elongated members 62, 64, 66, and 68 of embodiment 10B are not universal, although being identical in construction.

FIGS. 4 and 5 described a third embodiment of the present invention 10C which includes pairs of elongated members 80 and 82, each pair including universal and identical elongated members. For example, pair 80 includes elongated members 84 and 86. Pair 82 includes elongated members 88 and 90. Further, elongated members 84 and 90 of pairs 80 and 82, respectively, each include a pair of slots facing toward opposite side portions which are equidistant from the end surfaces. However, elongated member 84 possesses an edge portion transverse distance 92 which is greater than the edge portion transverse distance 94 of exemplar member 90.

FIG. 4 also illustrates a variation of all the embodiments where vertical legs 85, 87, and 89 are connected to the bases of members 84, 86, 88 and 90. Vertical legs 85, 87, and 89 would increase the height of platform 34 above base surface 32.

Turning now to FIG. 6, the fourth embodiment 10D is shown in which elongated members 96, 98, 100, and another one identical thereto are illustrated. Using elongated member 100 as an example of the elongated members employed in embodiment 10D it may be observed that elongated member 100 includes a pair of oppositely facing slots which are equidistant from end surfaces 102 and 104 thereof. Slot floors 106 and 108 lie in planes 110 and 112 which intersect one another. Nevertheless, elongated member 100 is a universal elongated member and identical to the other members constituting the support structure 10D.

Figure 7:
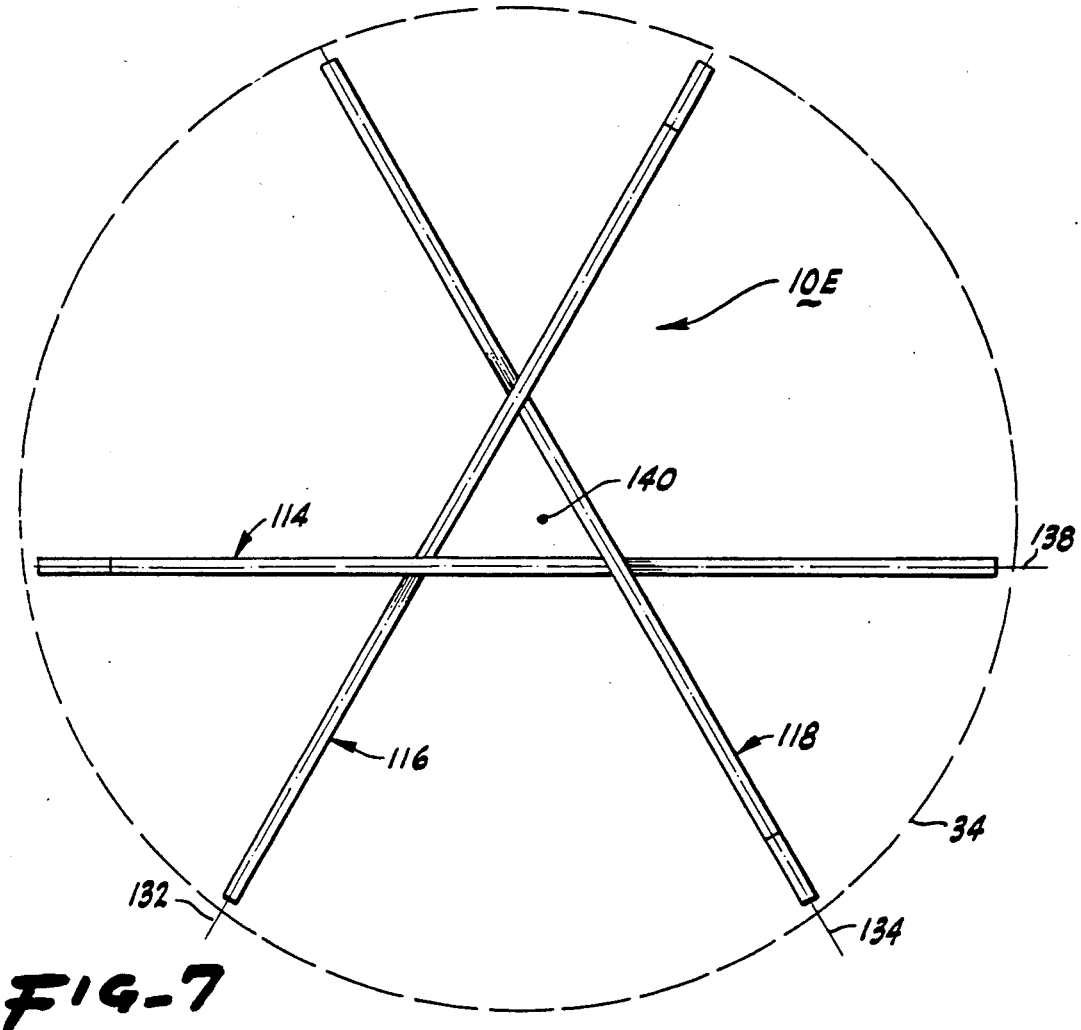
FIG. 7 is a top plan view of a fifth embodiment of the present invention utilizing a trio of elongated members each of universal construction.
Figure 8:
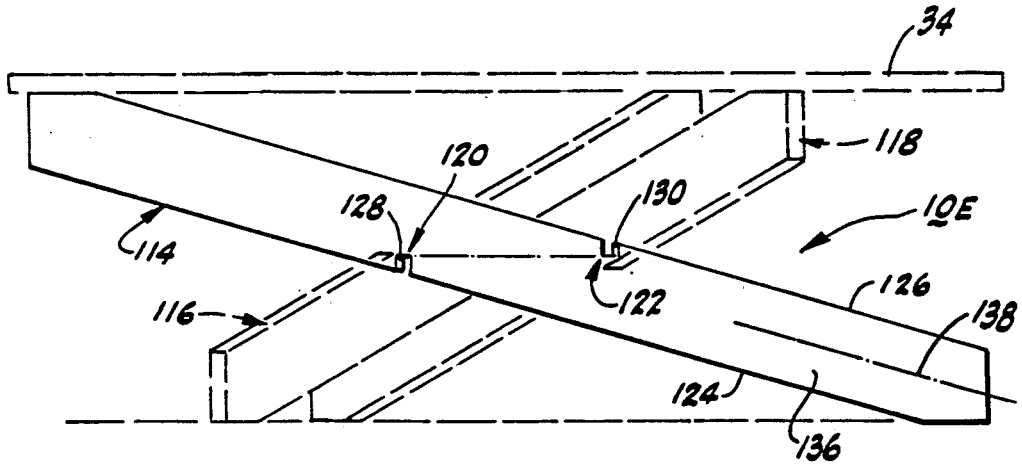
FIG. 8 is a side elevational view of the embodiment depicting in FIG. 7.

With reference to FIGS. 7 and 8, another embodiment 10E of the present invention is shown. Embodiment 10E includes identical and universal elongated members 114, 116, and 118. Embodiment 10E, thus, only requires three identical and universal members to form a structure supporting platform 34. Referring now to exemplar elongated member 114, FIG. 1 represents a pair of slots 120 and 122 found on opposite side portions 124 and 126. Slots 120 and 122 include floors 128 and 130 which are co-planar. However, slots 120 and 122 lie along axes 132 and 134 of elongated members 116 and 118, respectively. As such, the axial orientation of slots 120 and 122 is not orthogonal relative to flat edge surface 136. Moreover, axes 132 and 134 do not lie in planes which are orthogonally oriented relative to axis 138 of member 114. It should be noted that central portion 140 of support structure 10E forms an equilateral triangle.

Figure 9:
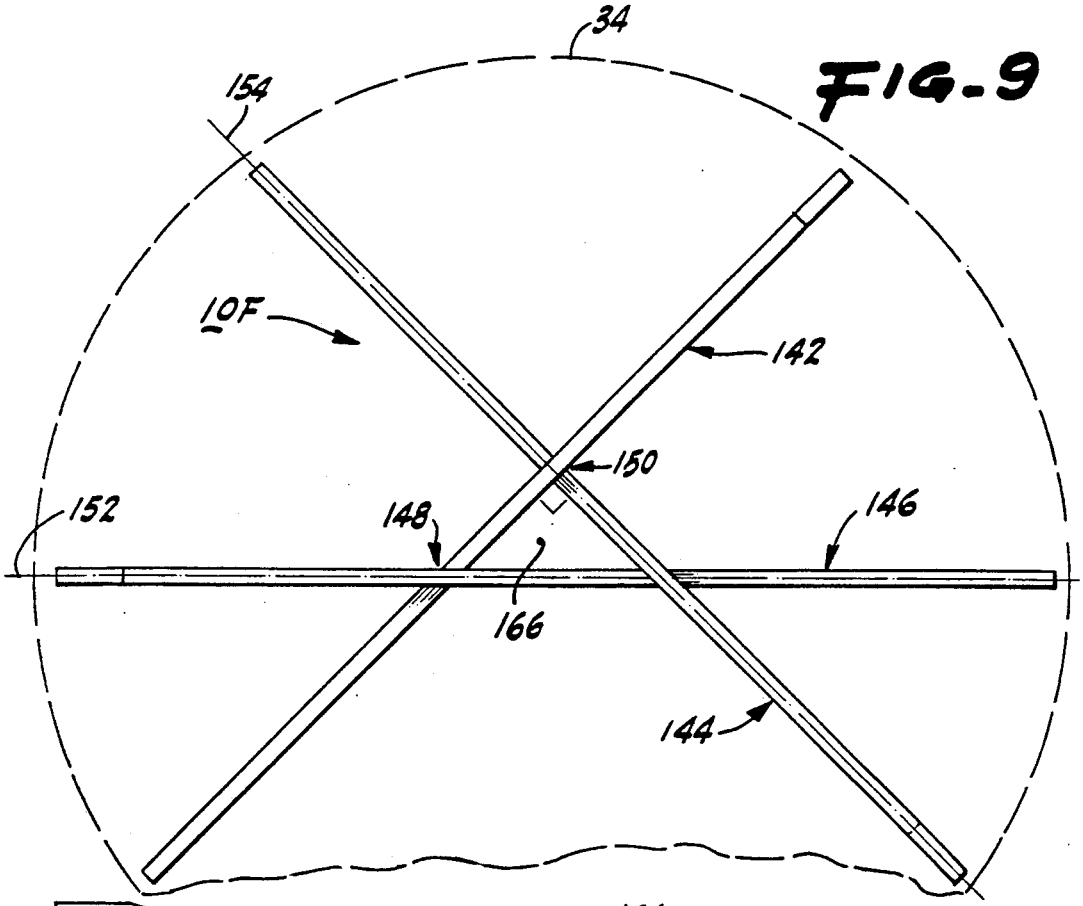
FIG. 9 is a top plan view of a sixth embodiment of the present invention utilizing a trio of elongated members.
Figure 10:
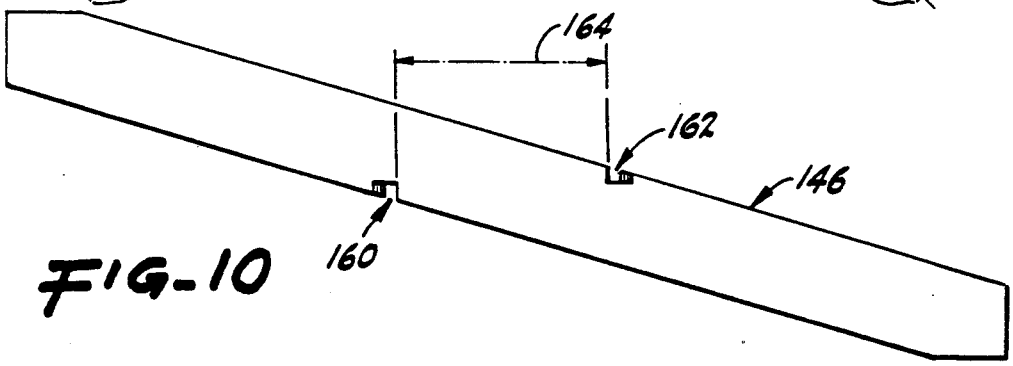
FIG. 10 is a side elevational view of one type of elongated member used in the embodiment of FIG. 9.
Figure 11:
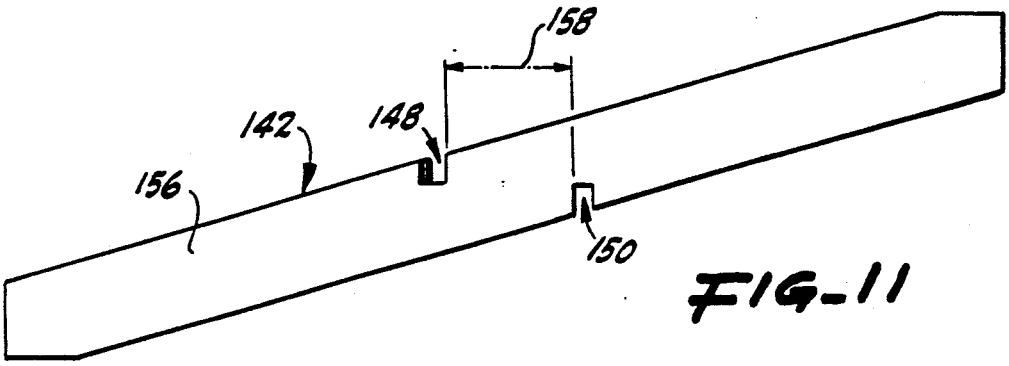
FIG. 11 is a side elevational of another type of elongated element used in the embodiment depicted in FIG. 9.

With reference to FIGS. 9–11 the embodiment 10F is shown which employs elongated members 142 and 144, of identical configuration, and elongated member 146 which is of singular construction. FIGS. 10 and 11 depict elongated members 146 and 142. Elongated member 146 is essentially similar to elongated member 114 depicted in FIG. 8. Elongated member 142 includes a pair of slots 148 and 150 which lie along axes 152 and 154 of the elongated member 146 and 144. Therefore, slot 150 is orthogonal to edge surface 156 of elongated member 142 while slot 148 lies in a non-orthogonal orientation thereto. It should be noted that the distance between slots 148 and 150, directional arrow 158, is less than the distance between slots 160 and 162 of elongated member 146, FIG. 10, directional arrow 164.

Figure 12:
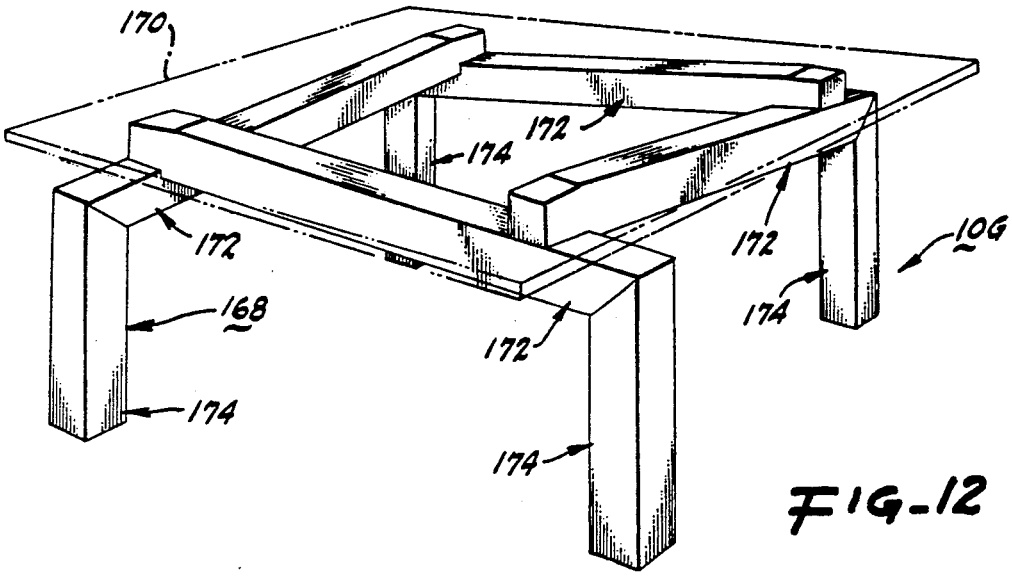
FIG. 12 is a top right perspective view of a base or a platform for a table utilizing a sixth embodiment of the present invention.

Referring now to FIG. 12 it may be observed that a universal support structure is depicted and is shown as being assembled into a platform 168 for a top portion 170, depicted in phantom. With further reference to FIGS. 13–16 it should be seen that a typical universal support member 10G is shown having an elongated member 172 which is angularly connected to elongated member 174 serving as a leg for platform 168. Elongated member 172 includes a slot 176 having a floor portion 178 and a wall portion 180. Elongated member 172 extends along axis 182 and includes a first side portion 184 and an opposite second side portion 186, which terminates in ends 188 and 190. End 188 serves as a place of connection between elongated member 172 and elongated member 174. Elongated member 172 further includes a transverse thickness dimension 192. The longitudinal distance along wall segment 194 is at least equal to the transverse thickness dimension 192 of elonqated member 172. The transverse dimension of floor 178 along wall segment 196 is less than the transverse thickness dimension 192 of elongated member 172. Slot 176 also possesses a depth dimension along portion 180 relative to side portion 184. Needless to say, slot 176 is open on or toward side portion 184.

Elongated member 172 also includes a first notch 198 and an adjacent notch 200 which is open on side 186 of the elongated member 172. First notch 198 includes a floor portion 202 and a wall portion 204, the depth of which at least equals the depth dimension of slot 176. Wall 204 lies in abutment with wall segment 194, in the embodiment depicted, when platform 168 is assembled. Second notch 200 includes a wall portion 206 and a floor portion 208. The longitudinal dimension of floor portion 208 relative to axis 182 substantially equals the transverse dimension of slot 176. Thus, the floor portion 208 of second slot 200 occupies the floor portion 178 of slot 176 during assembly of platform support 168. It should be noted that floor portion 208 of notch 200 is substantially parallel to floor portion 178 of slot 176. On the other hand, floor 202 of notch 198 is canted to conform to the upwardly slanting orientation of first side 184 of the elongated member 182. Thus, the floors 202 and 208 of first and second notches 198 and 200, respectively, lie in substantially non-parallel orientation. Although floor 202 of first notch 198 is not parallel to side portion 184, floor 202 does conform to the slanting surface of a like member to elongated member 172 during assemblage, 12.

Figure 17:
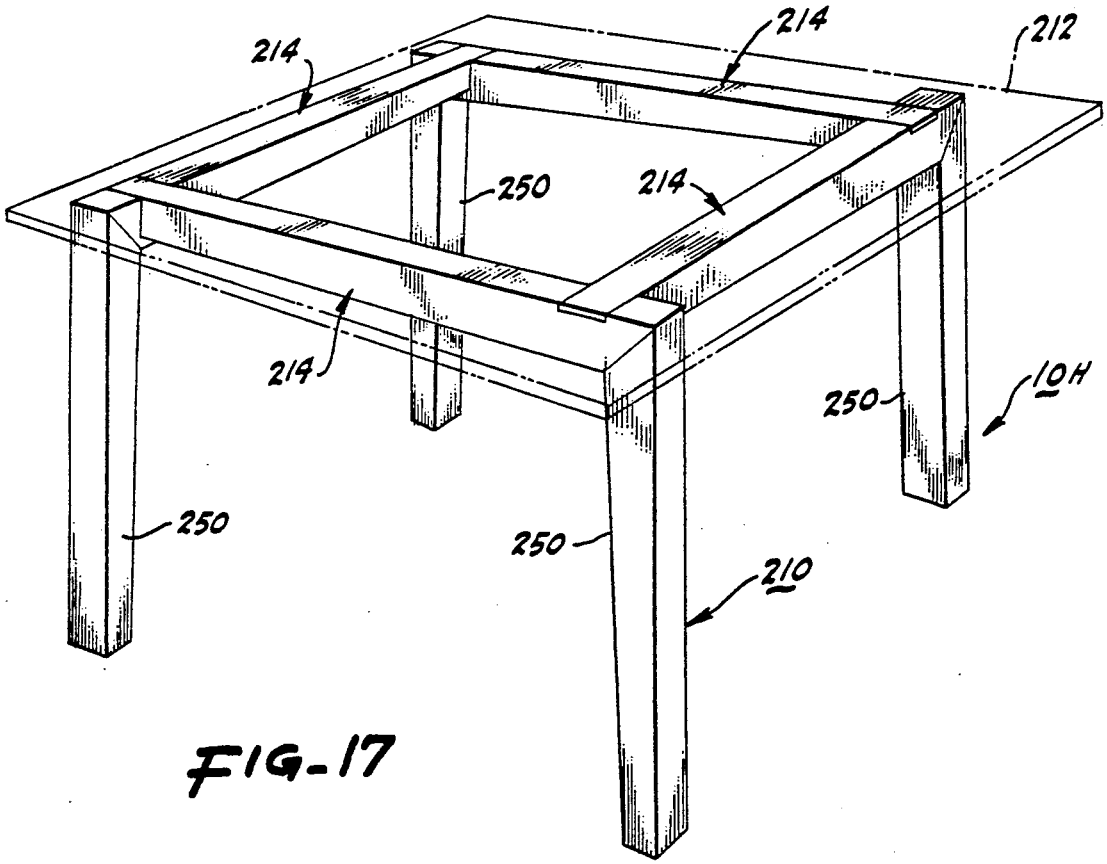
FIG. 17 is a top right perspective view of a seventh embodiment of the present invention using a universal member assembled into a base for a platform.
Figures 13, 14, 15, 16:
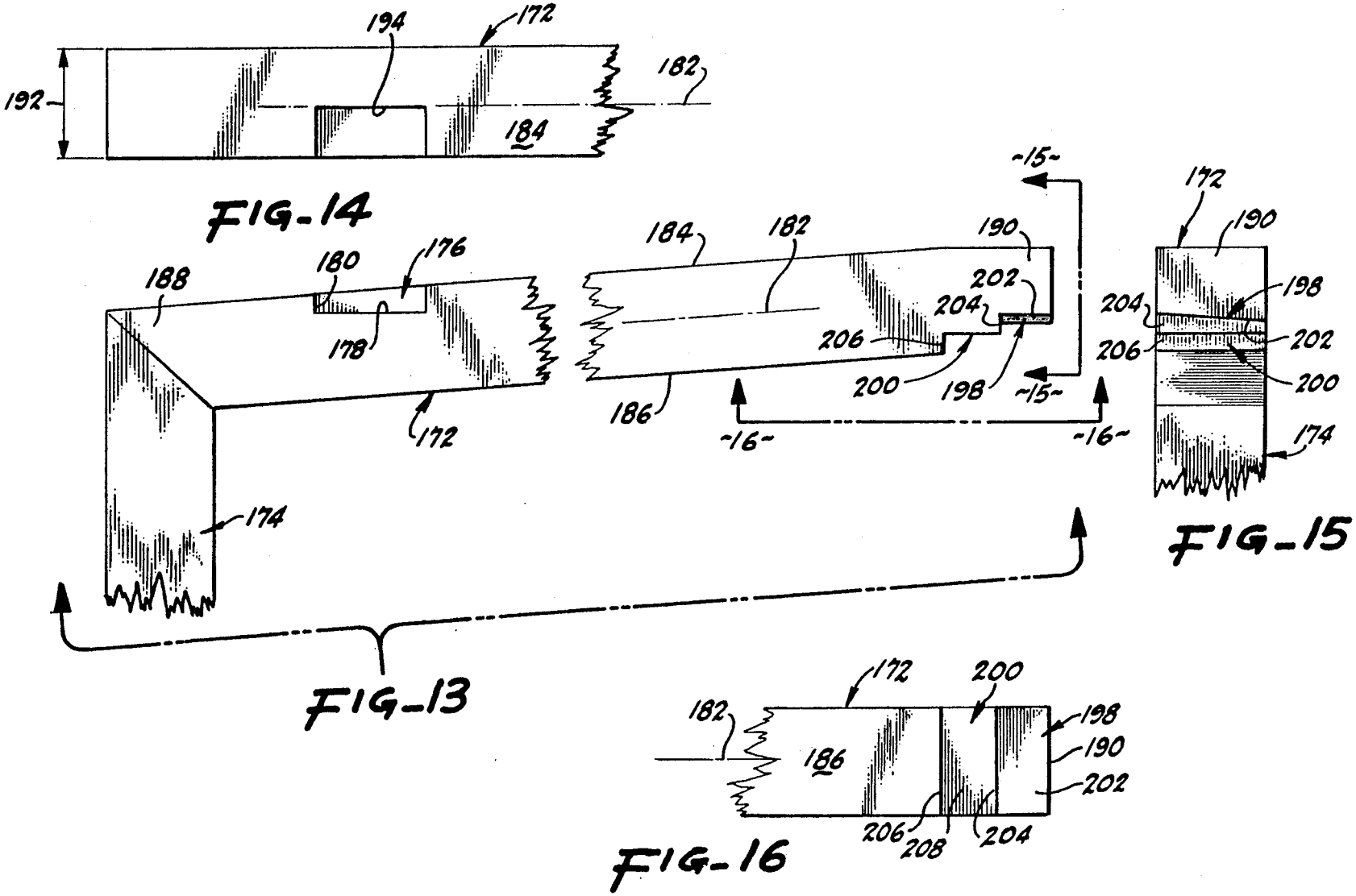
FIG. 13 is a side, broken, elevational view depicting the universal support structure shown in FIG. 12.
FIG. 14 is a top plan view of the slot depicted on the left hand side of FIG. 13.
FIG. 15 is a view taken along line 15—15 of FIG. 13.
FIG. 16 is a view taken along line 16—16 of FIG. 13.
Figures 18, 19, 20, 21, 22:
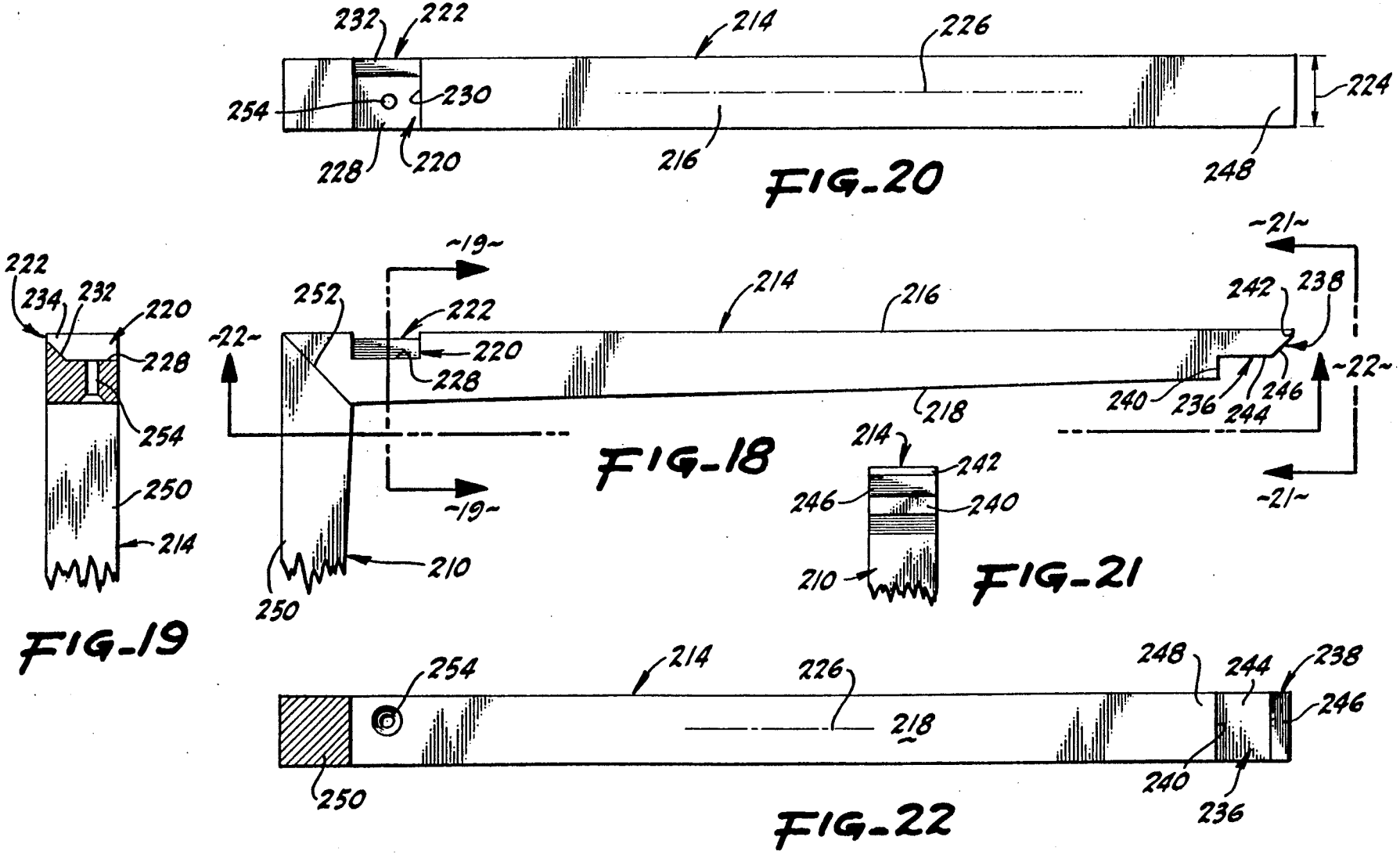
FIG. 18 is a side elevational view of the universal member depicted in FIG. 17.
FIG. 19 is a view taken along line 19—19 of FIG. 18.
FIG. 20 is a top plan view of the universal member depicted in FIG. 18.
FIG. 21 is a end view taken along line 21—21 of FIG. 18.
FIG. 22 is a sectional view taken along line 22—22 of FIG. 18.

FIG. 17 represents yet another embodiment 10H of the present invention in which quartet of universal members is formed into a support 210 for a top 212 (shown in phantom). FIGS. 19–22 depict typical universal member 216 having a first side portion 216 and a second side portion 218. A pair of slots 220 and 222 are placed adjacent one another and open toward first side portion 216. Slot 220 has a greater depth than slot 222. Both slots 220 and 222 possess a longitudinal distance which is at least equal to the thickness dimension 224 of member 214 relative to axis 226. Slot 220 includes a floor portion 228 and a wall portion 230. Slot 222 includes a floor portion 232 and a wall portion 234. Thus, slot 220 has a depth dimension along wall portion 230 while slot 222 includes a depth dimension along wall portion 234. First notch 236 and second notch 238 face outwardly from second side 218 of member 214. The depth of notch 236 is determined along wall portion 240 while notch 238 includes a depth measured vertically between end wall 242 and floor 244 of notch 236 along mitred wall 246. To produce a flush surface on assemblage support 210, the depth of slot 230 equals the distance between floor 244 of notch 236 and first side 216 of member 214 at end 248. Thus, in assemblage 210, mitred wall 246 of notch 238 abuts a wall portion comparable to wall portion 230 on a member constructed identically to member 214. Elongated member 250 may be orthogonally connected to member 214 at second end 252, FIG. 18. Fastener 254 may be employed to hold interlocking member, such as member 214, together to form assemblage 10.

In operation, the user assembles the elongated members found in embodiments 10A–10H as depicted in the drawings by interlocking slots. Embodiment 10A, 10D, 10E, 10G, and 10H show universal members which may be assembled in any direction and are identically constructed. The members depicted in embodiment 10B, although identically constructed, must be assembled in one way as shown in FIG. 2 and 3. Embodiment 10C illustrated in FIGS. 4 and 5 show two pairs of universal members which must be assembled as shown. The embodiment 10F, FIGS. 9–11, must be assembled as shown to form a central portion 166 which takes the form of an isosceles triangle. Disassembly of all the embodiments depicted in the drawings would simply entails the reverse process of assembly, i.e. removing slot portions of particular elongated members for slot portions of other elongated members.

While in the foregoing embodiments of the invention have been set forth in considerable detail for the purposes of making a complete disclosure of the invention it may be apparent to those of ordinary skill in the art that numerous changes may be made in such details without departing from the spirit and principles of the invention.

WHAT IS CLAIMED IS

1. A universal support structure capable of being assembled with like structures to form a base for a platform comprising:

one elongated member extending along an axis and including a transverse thickness dimension relative to said axis, said elongated member including first and second side portions terminating in first and second ends of said elongated member, respectively, said elongated member including one slot having a floor portion and a wall portion, the longitudinal distance along said floor portion relative to said axis being at least equal to said transverse thickness dimension of said one elongated member, the transverse distance along said floor portion being less than said thickness dimension of said one elongated member, said one slot being open on said first side portion of said one elongated member, said one slot further possessing a depth dimension along said wall portion, thereof relative to said first side portion of said one elongated member, said one elongated member further including a first notch having a floor portion and a wall portion, said first notch being open on said opposite second side portion of said elongated member, said first notch possessing a depth dimension along said wall portion thereof relative to said second side portion of said elongated member, said depth dimension of said first notch being at least equal to said depth dimension of said one slot, said one elongated member further including a second notch adjacent said first notch, said second notch extending from the top of said wall portion of said first notch and including a floor portion having a longitudinal dimension no greater than equal to said transverse dimension of said one slot, said first and second notches being located at the terminus of first end of the elongated member.

2. The universal support structure of claim 1 in which the floor of said one slot is substantially parallel to said floor of said second notch.

3. The universal support structure of claim 2 in which said floor of said first notch lies in substantially non-parallel orientation relative to said floor of said second notch.

4. The universal support structure of claim 3 in which said floor of said first notch lies in substantially non-parallel orientation relative to said first side portion of said one elongated member.

5. The universal support structure of claim 1 which further includes another elongated member angularly connected to said one elongated member at the second end of the one elongated member.

6. The universal support structure of claim 1 which additionally comprises another slot adjacent said one slot, said another slot having a floor portion and a wall portion, the longitudinal distance along said floor portion of said another slot relative to said axis being at least equal to said transverse thickness dimension of said one elongated member, the transverse distance along said floor portion of said another slot being less than said thickness dimension of said one elongated member, said another slot being open on said first side portion of said one elongated member, said another slot further possessing a depth dimension along said wall portion thereof relative to said first side portion of said one elongated member, said one slot.

7. The universal support structure of claim 1 in which said second notch includes a wall portion and a depth dimension along said wall portion; said depth dimension of said one slot being substantially equal to the distance between said floor of said second notch and said first side of said first elongated member at said first end, thereof.

8. The universal support structure of claim 7 which additionally comprises another elongated member angularly connected to said one elongated member.

9. The universal support structure of claim 8 in which said one and another elongated members are substantially orthogonally connected.

* * * * *